United States Patent [19]

Kuwano et al.

[11] Patent Number: 4,759,205

[45] Date of Patent: Jul. 26, 1988

[54] MULTI-PASS ROLLING METHOD AND MULTI-PATH ROLLING-MILL STAND FOR CARRYING OUT SAID METHOD

[75] Inventors: Hiroaki Kuwano, Yokohama; Takao Kawanami; Ken Okudaira, both of Kitakyushu; Akihiro Tanaka, Hachioji, all of Japan

[73] Assignees: Ishikawajima-Harima Jukogyo Kabushiki Kaisha; Nippon Steel Corporation; Kabushiki Kaisha Toshiba, all of Japan

[21] Appl. No.: 844,894

[22] Filed: Mar. 27, 1986

[30] Foreign Application Priority Data

May 23, 1985 [JP] Japan ..... 60-110880
May 23, 1985 [JP] Japan ..... 60-110881

[51] Int. Cl.[4] ..... B21B 13/04; B21B 37/8; B21B 31/32

[52] U.S. Cl. ..... 72/8; 72/11; 72/16; 72/20; 72/21; 72/37; 72/232; 72/243; 72/245

[58] Field of Search ..... 72/245, 243, 241, 240, 72/232, 233, 234, 205, 8–12, 16, 20, 21, 37

[56] References Cited

U.S. PATENT DOCUMENTS 4,382,375 5/1983 Yamamoto et al. ..... 72/205
4,478,064 10/1984 Brennemann ..... 72/243 X

FOREIGN PATENT DOCUMENTS 0018249 5/1971 Japan ..... 72/12
0076948 7/1978 Japan ..... 72/245
0046159 4/1979 Japan ..... 72/232
0039103 4/1981 Japan ..... 72/241
0118219 7/1984 Japan ..... 72/240
0076211 4/1985 Japan ..... 72/232

*Primary Examiner*—Robert L. Spruill
*Assistant Examiner*—Steven Katz

[57] ABSTRACT

A multi-pass rolling method which permits a multi-pass rolling-mill stand to perform multi-path rolling and still stabilize the rolling operation by preventing lateral deviation movement of a metal workpiece being rolled. The rolling-mill stand has three or more work rolls arranged one above the other and the workpiece is simultaneously rolled at two or more points by at least one of the work rolls. Directly or indirectly roll gaps are detected on the work and drive sides of at least one pass by sensors. A difference signal from the output signals of the sensors is obtained thereby determining a roll gap difference. Control devices are provided which are responsive to the difference signal for independently changing the roll gaps on the work and drive sides.

3 Claims, 13 Drawing Sheets

MULTI-PASS ROLLING METHOD AND MULTI-PATH ROLLING-MILL STAND FOR CARRYING OUT SAID METHOD

BACKGROUND OF THE INVENTION

The present invention relates to a multi-pass rolling method which can permit a single rolling-mill stand to perform multi-path rolling and can stabilize the rolling operation by preventing the lateral deviation movement of a metal workpiece being rolled, thereby producing rolled products having a satisfactory degree of shape or flatness and to a multi-pass rolling-mill stand best adapted for carrying out said multi-pass rolling method.

In rolling operation, under some rolling conditions, a workpiece being rolled cannot remain at a predetermined pass between a pair of upper and lower rolls so that, as indicated by the one-dot chain lines in FIG. 1, the workpiece being rolled is caused to displace itself toward one ends of the pair of upper and lower rolls. This phenomenon, the parallel displacement to the width direction of the workpiece is well known in the art and is called "lateral deviation movement" in the specification.

The lateral deviation movement of a workpiece being rolled by a conventional rolling-mill stand will be briefly described below. In the case of rolling a workpiece by a rolling-mill stand, the rolling pressure exerted at the work side (the side away from drive means for driving rolls) becomes different from that exerted at the drive side (the side near the drive means) due to the rolling operation conditions such as the difference in hardness in the widthwise direction of a workpiece being rolled, a taper in the widthwise direction of a workpiece being rolled, the off-center (that is, the centerline of a workpiece being rolled being not correctly aligned with the center of a pair of upper and lower rolls) and so on, so that there results a difference in roll gap between the work and drive sides. Therefore there occurs difference in elongation of a workpiece between the work and drive sides and the entering velocity of the workpiece becomes faster on the side at which the gap is increased. As a result, as shown in FIG. 1, the upstream portion of a workpiece a being rolled is inclined as indicated by an arrow e relative to the rolling direction (indicated by an arrow c) and the inclined workpiece a being rolled is drawn in the direction perpendicular to the axis of the roll b so that the workpiece a being rolled is caused to be displaced laterally in the direction in which the roll gap is increased. Therefore the difference in roll gap between the work and drive sides is further increased. In this case, a roll gap as shown in FIG. 2 is formed and the lateral deviation movement of a workpiece a being rolled results in the direction indicated by an arrow f. If the lateral deviation movement of the workpiece a being rolled occurs, the workpiece a being rolled does not return by itself to its normal path; some countermeasure is needed to return it in position.

The lateral deviation movement in question is a utterly unstable phenomenon from the viewpoint of control engineering. Once happening, it cannot be suppressed without using some positive control means, as mentioned above. This is further explained with respect to FIGS. 17(A) to 17(D). Little asymmetry causes slight roll skewing (FIG. 17(A)); and the strip a is drawn in faster at the wider roll gap side (FIG. 17(B)) so that the strip a is inclined as shown in arrow e against the direction c of the travel (FIG. 17(C)). As a result, the strip a goes away from the center of the track ever faster (FIG. 17(D)). Therefore the difference in roll gap between the work and drive sides is further increased. These steps repeat themselves so that the lateral deviation develops more and more, resulting in further and further deviation of the strip towards one side.

As described above, when the difference in roll gap between the work and drive sides (to be referred to hereinafter as "the left and right sides", respectively) of the rolling-mill stand, the lateral deviation movement of the workpiece being rolled results. It follows therefore that in order to prevent such lateral deviation movement, the roll gap on the side of the displacement of the workpiece being rolled must be decreased, which is clear from the above-mentioned analysis on the lateral deviation movement.

Meanwhile RD (Rolling Drawing) process in which a workpiece being rolled is wrapped around work rolls having different peripheral velocities has been proposed and demonstrated so that the rolling-mill stands can be made compact in size, roll wear is minimized, it becomes possible to roll hard metals such as high tension steel and edge drops are reduced. As one of the modifications of the RD process, there has been devised and demonstrated a one-stand multi-pass rolling process in which three or more work rolls having different peripheral velocities are arranged one above the other and a workpiece being rolled is wrapped around the work rolls so that the workpiece is rolled at each pass between the adjacent work rolls. There has been also proposed and demonstrated another modification also called a one-stand multi-pass rolling process in which a workpiece being rolled is not wrapped around the work rolls, but is passed between the adjacent work rolls. As compared with the one-stand single-pass rolling process, the one-stand multi-pass rolling process can roll a workpiece under a high reduction at a relatively low rolling force and has a high degree of productivity. In addition, the one-stand multi-pass rolling process is adapted to make a rolling line compact in size.

However, in both of the one-stand multi-pass rolling process and the one-stand single-pass rolling methods, when there occurs the difference in roll gap between the work and drive sides of the rolling-mill stand, the lateral deviation movement of a workpiece being rolled results. Once the lateral deviation movement occurs, it is very difficult to return the workpiece being rolled to a predetermined stable path. Furthermore, the difference in rolling gap causes the incorrect shape of a final product.

In order to prevent the lateral deviation movement in the one-stand multi-pass rolling-mill stand, it may be proposed to apply tension to a workpiece being rolled at the entry side of the rolling-mill stand; but in the case of upper stream of the cold rolling, a considerably great power is required to apply a tensile force to a workpiece because of its thickness. For instance, if the non-parallelism between a workpiece to be rolled and the work rolls is 30 $\mu$m in the first rolling pass, a back tension on the order of 3 kg/mm$^2$ must be applied. If a metal workpiece is 4 mm in thickness and 1000 mm in width and the entering velocity is 500 m/min, the motor power as much as 1000 kw would be needed.

In view of the above, one of the objects of the present invention is to easily and positively prevent the lateral deviation movement of a workpiece being rolled without the need of a high power to substantially eliminate the damages at the edges of the workpiece being rolled and to prevent the workpiece from being broken or cracked and to ensure the stabilized rolling, thereby improving the rolling efficiency and the yield and providing rolled products having a satisfactory degree of shape or flatness.

The above and other objects, effects, features and advantages of the present invention will become more apparent from the following description of preferred embodiments thereof taken in conjunction with the accompanying drawings.

DETAILED DESCRIPTION OF THE PREFERRED EMBODIMENTS

Figure 1:
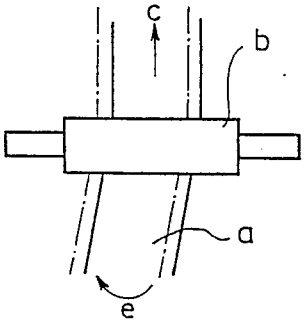
PRIOR ART Fig.1
FIGS. 1 and 2 are views used to explain why the lateral deviation movement occurs when a metal workpiece is being rolled.
Figure 2:
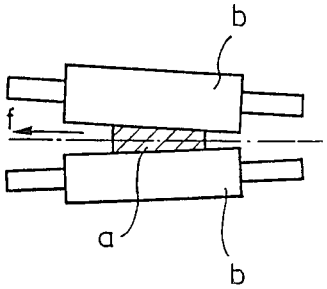
PRIOR ART Fig.2
Figure 3:
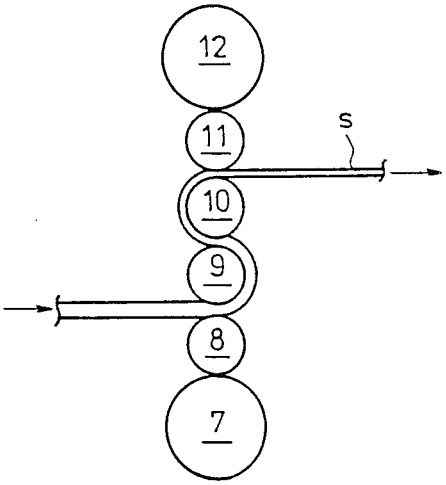
FIG. 3 shows a first embodiment of the present invention.
Figure 4:
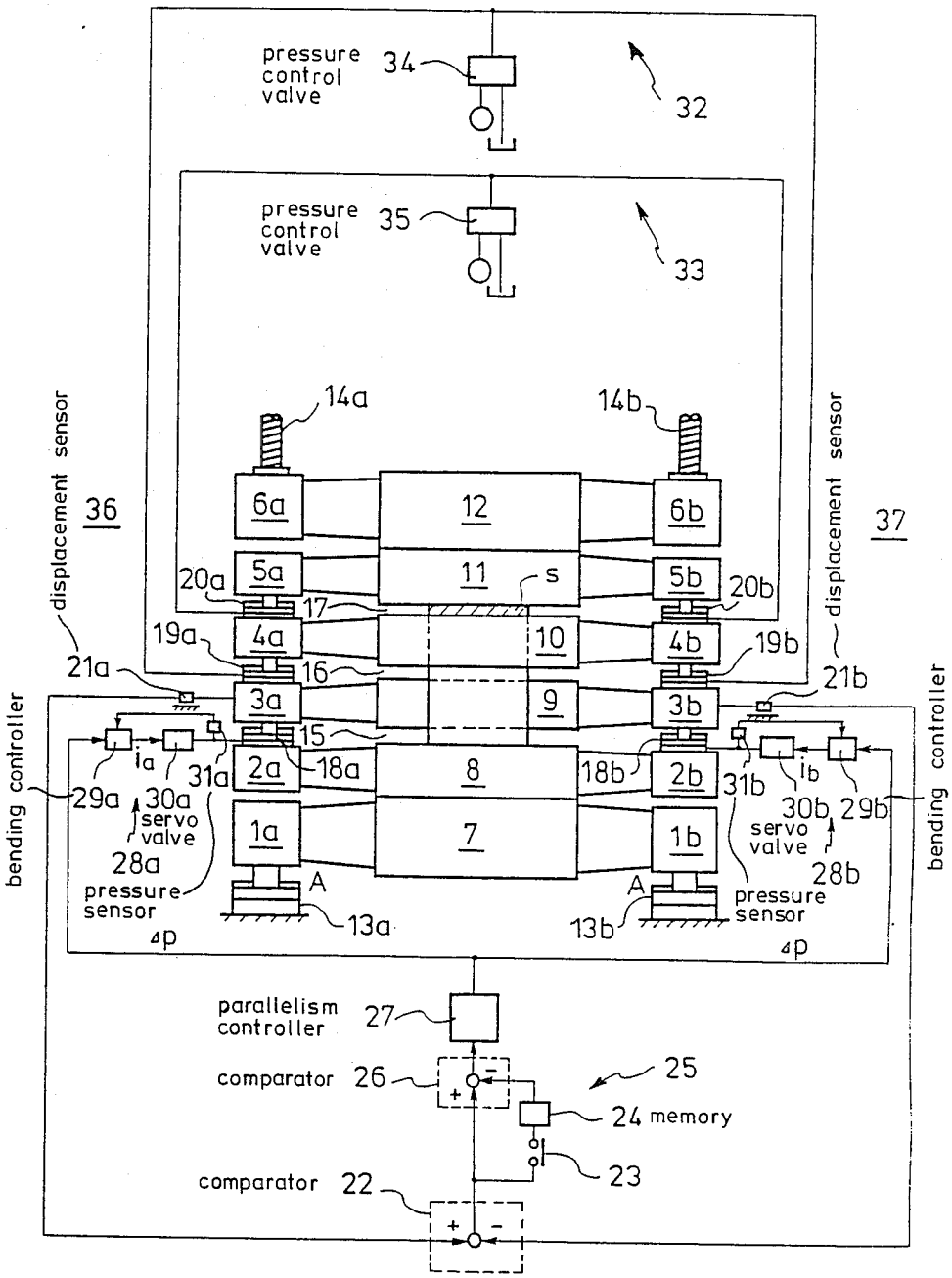
FIG. 4 is a front view thereof.

FIGS. 3 and 4 show a first embodiment of the present invention in which the parallelism of a first roll gap is controlled. In the windows of housing posts, roll chocks 1*a*, 2*a*, 3*a*, 4*a*, 5*a* and 6*a* and roll chocks 1*b*, 2*b*, 3*b*, 4*b*, 5*b* and 6*b* are disposed vertically upwardly in the order named so as to be slidable relative to the vertical walls. Work rolls 8, 9, 10 and 11 are rotatably supported by the roll chock pairs 2*a* and 2*b*, 3*a* and 3*b*, 4*a* and 4*b* and 5*a* and 5*b*, respectively, while backup rolls are rotatably supported by the roll chock pairs 1*a* and 1*b*; and 6*a* and 6*b*, respectively. Hydraulic cylinders 13*a* and 13*b* for exerting the rolling forces to the roll chocks 1*a* and 1*b*, respectively, are disposed on a lower side of the housing posts. Reduction screws 14*a* and 14*b* driven by electric motors (not shown) for exerting rolling forces to the roll chocks 6*a* and 6*b*, respectively, are mounted on an upper side of the housing posts.

As best shown in FIG. 3, a workpiece s passes through a first roll gap 15 defined between the work rolls 8 and 9, is partially wrapped around the work roll 9 and then passes through a second roll gap 16 defined between the work rolls 9 and 10, is partially wrapped around the work roll 10 and passes through a third roll gap 17 defined between the work rolls 10 and 11.

Hydraulic cylinders 18*a*, 18*b*, 19*a*, 19*b*, 20*a* and 20*b* are respectively interposed between the roll chock pairs 2*a* and 3*a*, 2*b* and 3*b*, 3*a* and 4*a*, 3*b* and 4*b*, 4*a* and 5*a*, and 4*b* and 5*b* so that each of the work rolls 8, 9, 10 and 11 is bent into a desired shape.

Outputs from displacement sensors 21*a* and 21*b* respectively mounted on the roll chocks 3*a* and 3*b* are transmitted to a comparator 22 and an output from the comparator 22 is compared in a comparator 26 with an output from a set-point control circuit 25 comprising a relay 23 and a memory 24. An output representing a parallelism deviation and derived from the comparator 26 is applied to a parallelism controller 27 so that right and left parallelism correction signals are derived and respectively applied to bending controllers 29*a* and 29*b* in roll bending control systems 28*a* and 28*b* for the first roll gap 15. Then, control signals are derived from the bending controllers 29*a* and 29*b* and respectively applied to servo valves 30*a* and 30*b* which control the flow rates of working fluid under pressure which is charged into or discharged out of the hydraulic cylinders 18*a* and 18*b*. Outputs from pressure sensors 31*a* and 31*b* to which respectively represent the pressures in the hydraulic cylinders 18*a* and 18*b* are fed back to the bending controllers 29*a* and 29*b*, respectively.

In FIG. 4, reference numeral 32 designates a roll balance control system for the second roll gap 16; and 33, a roll balance control system for the third roll gap 17. Upon starting of the rolling operation, the roll balance control system 32 supplies the working fluid under a predetermined pressure through a pressure control valve 34 to the hydraulic cylinders 19*a* and 19*b* so that the work roll 10 can be maintained in a predetermined position. The roll balance control system 33 supplies the working fluid under a predetermined pressure through a pressure control valve 35 to the hydraulic cylinders 20*a* and 20*b* so that the work roll 11 is pressed against the backup roll 12. Reference numeral 36 represents the work side of the rolling-mill stand while reference numeral 37, the drive side thereof. A reference character A denotes hydraulic reduction control systems including the hydraulic cylinders 13*a* and 13*b*.

In the initial setting stage prior to the rolling operation, the reduction screws 14*a* and 14*b* are driven by the electric motors (not shown) and are lowered without passing the workpiece s between the work rolls. Thus the respective rolls are made into contact with each other and the hydraulic reduction control systems A on the work and drive sides 36 and 37 control the hydraulic cylinders 13*a* and 13*b* such that a lateral load difference will not result (In general, such operation as described above is called "leveling").

Upon completion of "leveling", the relay 23 in the set point control circuit 25 is turned on so that the output just derived from the comparator 22 is stored into the memory 24 as a set point for the parallelism control of the first roll gap 15. Thereafter the workpiece s is caused to pass between the work rolls as shown in FIGS. 3 and 4 and the reduction screws 14*a* and 14*b* and the reduction hydraulic cylinders 13*a* and 13*b* exert a load so that the first, second and third roll gaps 15, 16 and 17 are defined and the rolling operation is started.

During the rolling operation, the vertical displacement of the work roll 9 is continuously detected by the displacement sensors 21*a* and 21*b* and the outputs from the displacement sensors 21*a* and 21*b* are applied to the comparator 22 so that the difference between the output from the displacement sensor 21*a* and the output from the displacement sensor 21*b* is derived which represents the inclination or out-of-parallelism of the work roll 9. Meanwhile, the work roll 8 is always position-controlled at its right and left sides, through the backup roll 7, respectively and independently from each other by the hydraulic reduction control systems A of the work and drive sides 36 and 37 so as to maintain the parallelism of the work roll 8. Therefore, detection of the inclination of the work roll 9 relative to the work roll 8 is directly utilized for control of parallelism of the first roll gap 15.

The obtained signal representative of the inclination of the work roll 9 is compared in the comparator 26 with the set point delivered from the memory 24 and a signal representative of the difference therebetween is applied to the parallelism controller 27 so that a pressure correction $\Delta p$ is obtained and applied to the bending controllers 29*a* and 29*b*. For instance, assume that the work roll 9 is inclined such that the first roll gap 15 is wider on the work side 36 and is narrower on the drive side 37. In such a case, in the bending controller 29*a*, $\Delta p$ is subtracted from the work-side initially set bending pressure $P_w$ while $\Delta p$ is added to the drive-side initially set bending pressure $P_w$ in the bending controller 29*b* so that the command signals $i_a$ and $i_b$ respectively representative of $P_w-\Delta p$ and $P_w+\Delta p$ are derived from the bending controllers 29*a* and 29*b* and applied to the servo valves 30*a* and 30*b*, respectively. In response to these command signals, the servo valve 30*a* controls the amount of working fluid to be discharged from the hydraulic cylinder 18*a* and the servo valve 30*b* controls the amount of working fluid to be charged into the hydraulic cylinder 18*b*. As a result, the pressure drop $\Delta p$ occurs in the hydraulic cylinder 18*a* while the pressure rise $\Delta p$ results in the hydraulic cylinder 18*b*. When the work roll 9 is made in parallel with the work roll 8; that is, when a lateral difference of the first roll gap is thus eliminated, the out-of-parallelism of the work roll 9 becomes zero and the command signals are not applied to the servo valves 30*a* and 30*b* any more. The lateral difference in roll gap is thus eliminated to make the work roll 9 in parallel with the work roll 8, whereby the lateral deviation movement of the workpiece s can be prevented so that finished products are obtained with a satisfactory degree of shape or flatness.

Figure 5:
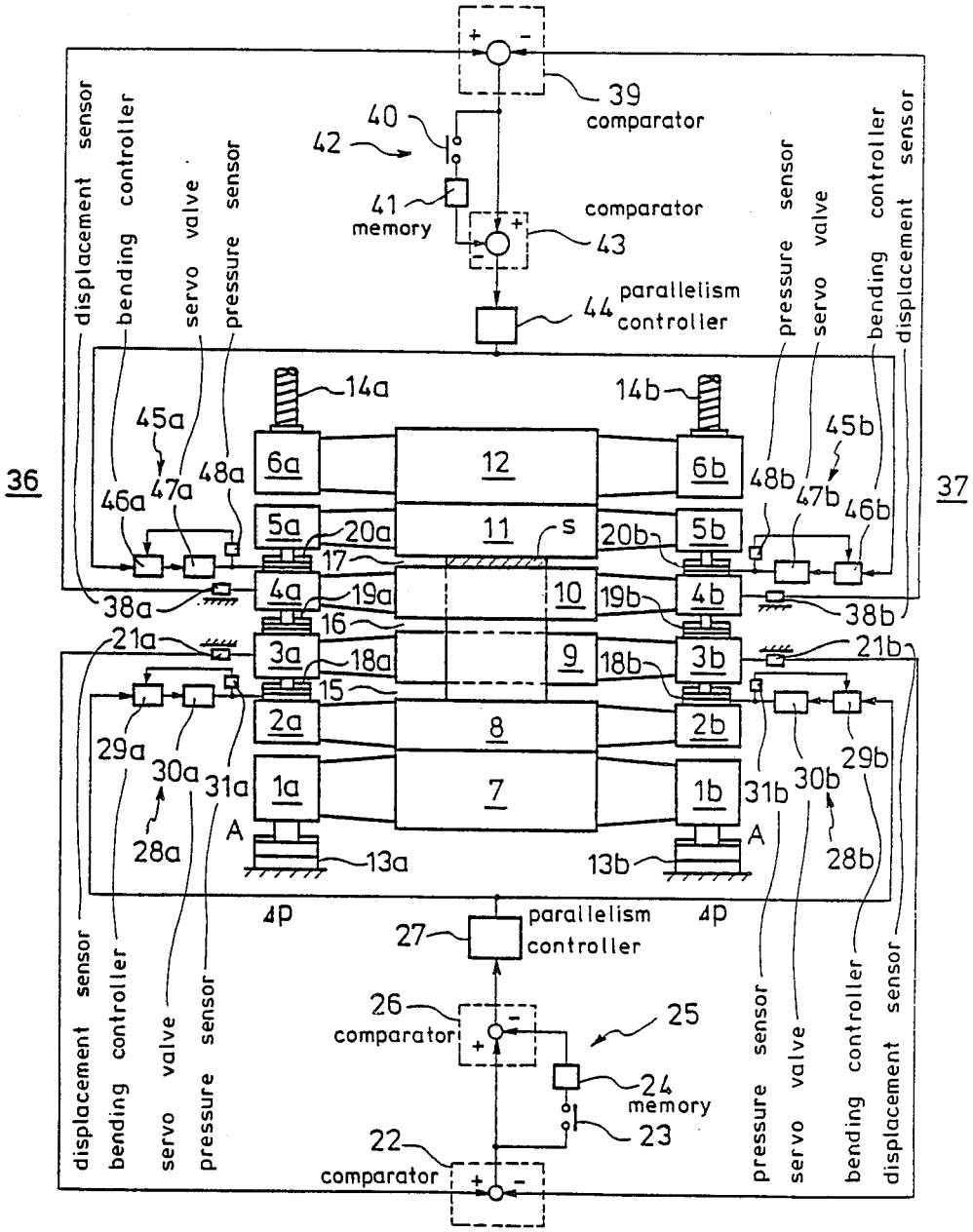
FIG. 5 is a front view of a second embodiment of the present invention.

FIG. 5 shows a second embodiment of the present invention in which the parallelism is controlled not only in the first roll gap 15 but also in the third roll gap 17. Reference numerals 38*a* and 38*b* designate displacement sensors respectively mounted on the roll chocks 4*a* and 4*b*; 39, a comparator for obtaining a difference signal between the output signals from the displacement sensors 38*a* and 38*b*; 42, a set point control circuit comprising a relay 40 and a memory 41; 43, a comparator for obtaining a difference signal between an output signal from the comparator 39 and an output from the set-point control circuit 42; 44, a parallelism controller which responds to an output signal from the comparator 43 to apply a pressure correction signal to bending controllers 46*a* and 46*b* in roll bending control systems 45*a* and 45*b*; 47*a* and 47*b*, servo valves which respond to the command signals from the bending controllers 46*a* and 46*b*, thereby controlling the flow rates of working fluid charged into and discharged out of the hydraulic cylinders 20*a* and 20*b*; and 48*a* and 48*b*, pressure sensors.

The rolling operation procedure is substantially similar to that of the first embodiment described above except that the first and third roll gaps 15 and 17 are concurrently controlled. For instance, assume that the work roll 10 is inclined such that the third roll gap 17 is narrow on the work side and is wide on the drive side. Then the right and left bending pressures are so controlled that the roll gap on the work side is increased while the roll gap on the drive side is reduced.

The work roll 11 is always position-controlled at its right and left sides, through the backup roll 12, respectively and independently from each other by the reduction screws 14*a* and 14*b* of the work and drive sides 36 and 37 which are driven by electric motors (not shown) so as to maintain the parallelism of the work roll 11. Therefore, detection of the inclination of the work roll 10 relative to the work roll 11 is directly utilized for control of parallelism of the third roll gap 15.

Figure 6:
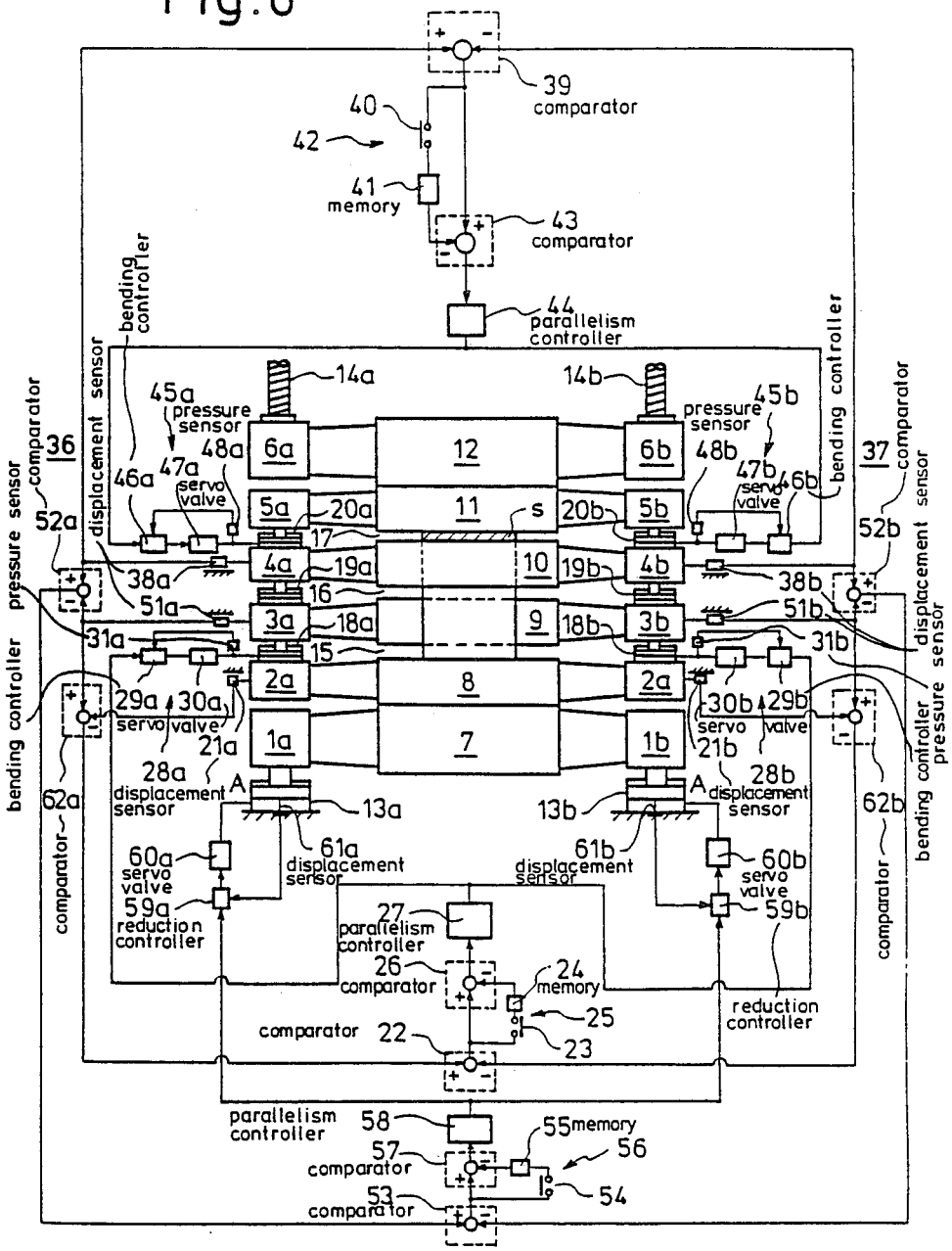
FIG. 6 is a front view of a third embodiment of the present invention.

FIG. 6 shows a third embodiment of the present invention in which the parallelism in all of the first, second and third roll gaps 15, 16 and 17 is controlled.

In FIG. 6, reference numerals 51*a* and 51*b* represent displacement sensors respectively mounted on the roll chocks 3*a* and 3*b*; 52*a* and 52*b*, comparators adapted to obtain a difference signal between output signals from the displacement sensors 51*a* and 38*a* and a difference signal between output signals from the displacement sensors 51*b* and 38*b*, respectively; 53, another comparator adapted for deriving a difference signal between output signals from the comparators 52*a* and 52*b*; 56, a set-point control circuit comprising a relay 54 and a memory 55; 57, a comparator adapted to obtain a difference signal between output signals from the comparator 53 and the set-point control circuit 56; 58, a parallelism controller which responds to the output signal from the comparator 57 to apply a pressure correction signal to reduction controllers 59*a* and 59*b* in the hydraulic reduction control systems A; 60*a* and 60*b*, servo valves adapted to respond to the command signals from the reduction controllers 59*a* and 59*b* so as to control the flow rates of working fluid to be charged into and discharged from the hydraulic cylinders 13*a* and 13*b*; 61*a* and 61*b*, displacement sensors adapted to detect the displacements of the ram of the hydraulic cylinders 13*a* and 13*b*; and 62*a* and 62*b*, comparators for obtaining a difference signal between output signals from the displacement sensors 21*a* and 51*a* and a difference signal between output signals from the displacement sensors 21*b* and 51*b*, output signals from the comparators 62*a* and 62*b* being applied to the comparator 22.

In the third embodiment, the free vertical displacements of the work rolls 9 and 10 are detected by the displacement sensors 51*a*, 38*a*, 51*b* and 38*b* the outputs from which are applied to the comparators 52*a* and 52*b* so that the difference between the vertical displacements of the work rolls 9 and 10 is determined. The output signals from the comparators 52*a* and 52*b* are applied to the comparator 53 so that any lateral out-of-parallelism of the second roll gap is determined. The output from the comparator 53 is compared in the comparator 57 with the set point delivered from the memory 55 to generate a difference signal which in turn is applied to the parallelism controller 58. The parallelism controller 58 obtains the corrections of the positions of the hydraulic cylinders 13*a* and 13*b* in the hydraulic reduction control systems A so as to adjust the parallelism of the second roll gap 16. Next the command signals are applied through the reduction controllers 59*a* and 59*b* to the servo valves 60*a* and 60*b* which in turn control the flow rates of working fluid to be charged into and discharged out of the hydraulic cylinders 13*a* and 13*b*, whereby the parallelism of the second roll gap 16 is controlled. For instance, assume that the work roll 9 is so inclined that the second roll gap is narrower on the work side 36 and is wider on the drive side 37. Then, the ram of the hydraulic cylinder 13*a* is lowered while simultaneously the ram of the hydraulic cylinder 13*a* is raised. The set point is determined as described in the first embodiment.

The control of the second roll gap 16 also affects the first and third roll gaps 15 and 17. Therefore, in the first roll gap control system, the output signals from the displacement sensors 51*a*, 21*a*, 51*b* and 21*b* are delivered to the comparators 62*a* and 62*b* so that the difference in vairation on the right and left sides of the first roll gap 15 are determined and applied to the comparator 22. Thus, the out-of-parallelism of the roll gap 15 is determined and the parallelism of the first roll gap is controlled based upon the out-of-parallelism determined in the manner described above. In the third roll gap control system, the parallelism of the third roll gap 17 is controlled in a manner substantially similar to that described above with reference to the second embodiment.

In the first embodiment, the parallelism of the first roll gap 15 only is controlled. This is because the tensile stress at the entering side of the roll gap 15 is lower than those of the remaining roll gaps 16 and 17 so that lateral deviation movement tends to occur at the very roll gap 15. In the second embodiment, the parallelism of not only the first roll gap 15 but also the third roll gap 17 is controlled since out-of-parallelism of the roll gap 17 may cause the workpiece s to be finished with an unsatfisfactory degree of shape or flatness especially when the workpiece is thin. With the embodiments described above, the lateral deviation movement of the workpiece and thus the ill shape or flatness of the finished product can be prevented to a considerable extent.

Figure 7:
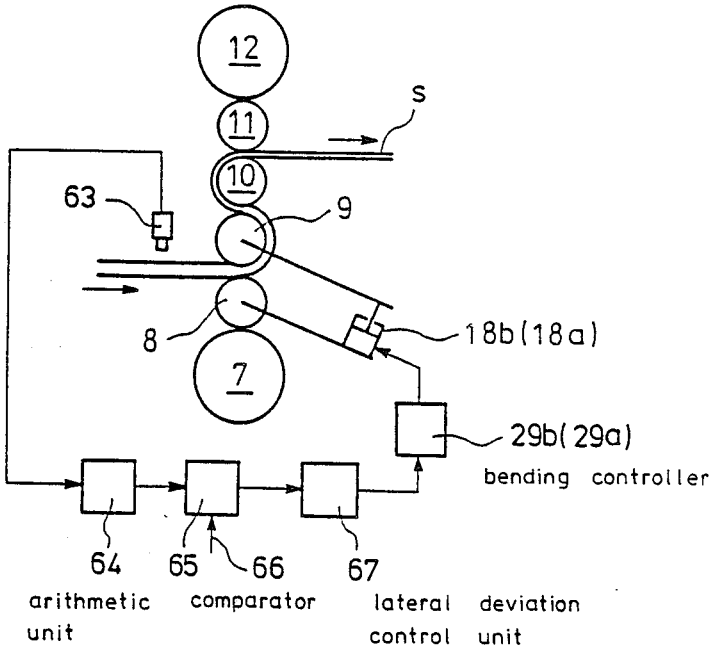
FIG. 7 is a schematic view of a fourth embodiment of the present invention.
Figure 8:
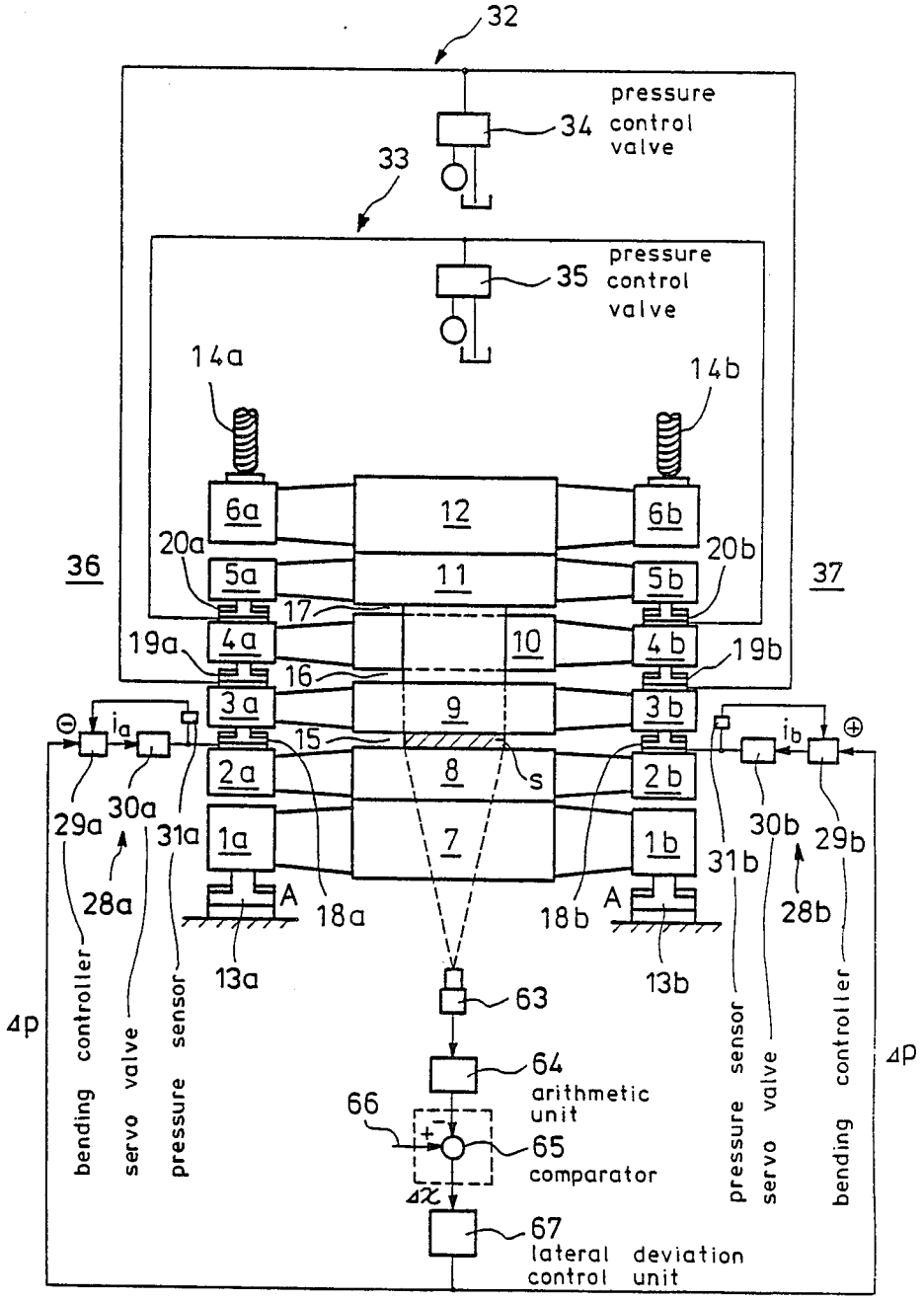
FIG. 8 is a front view thereof.
Figure 9A:
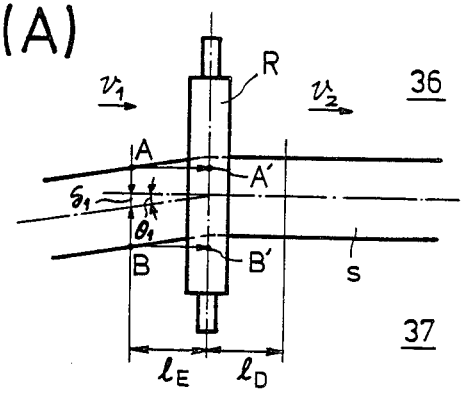
FIGS. 9(A), 9(B) and 9(C) are views used to explain the arrangement of sensors for detecting the edge of a workpiece being rolled used in the fourth embodiment.
Figure 9B:
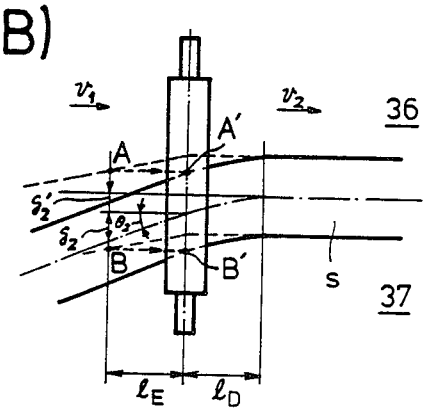
Figure 9C:
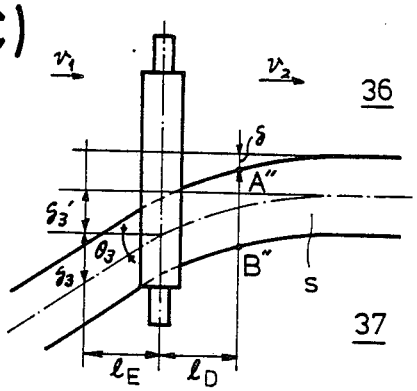

FIGS. 7–9 show a fourth embodiment of the present invention adapted to more positively prevent the lateral deviation movement of a workpiece being rolled. A sheet edge sensor 63 is disposed at a predetermined position on the entering or discharging side of a rolling-mill stand. It is prefereable that the sheet edge sensor 63 is located as closely as possible to the rolling-mill stand on the entering side thereof because, depending upon whether the sheet edge sensor 63 is disposed on the entering or discharge side of the rolling-mill stand, the displacement of the workpiece being rolled becomes different. As shown in FIGS. 9(A), 9(B) and 9(C), as the result of the lateral deviation movement due to the roll gap, the rolled metal leaving the rolling-mill stand have a camber represented by a hyperbola which changes rapidly. It follows therefore that unless the sheet edge sensor is located as close to the roll gap as possible on the discharge side of the rolling-mill stand, the displacement of the rolled workpiece s cannot be detected satisfactorily. Furthermore, the time during which the rolled workpiece travels from the roll gap to the sheet edge sensor becomes a dead time.

If the metal workpiece s is not forced to be restrained on the entering side of the rolling-mill stand (by, for instance, using a strong guide or by applying strong back tension), the metal workpiece s is easily deflected toward the right or left due to the difference in reduction in widthwise direction of the metal workpiece. If the metal workpiece is drawn under this condition, the lateral deviation movement occurs as described above. When the sheet edge sensor is disposed on the entering side of the rolling-mill stand, not only the displacment of the metal workpiece due to its lateral deviation movement but also the displacement thereof due to the inclination can be detected.

Further explanation will be made on FIGS. 9(A), 9(B) and 9(C) which show progress of lateral deviation movement of the workpiece s with the lapse of time.

The workpiece s begins to laterally deviate for some reason as mentioned previously as shown in FIG. 9(A) where reference numeral R denotes work roll; $l_E$, a distance of the sheet edge sensor 63 from the roll gap when the sensor is disposed on the entering side of the rolling-mill stand; $l_D$, a distance of the sheet edge sensor 63 from the roll gap when the sensor is disposed on the discharge side of the rolling-mill stand; $v_1$, a workpiece velocity at the entering side of the rolling-mill stand; and $v_2$, a workpiece velocity at the discharge side of the rolling-mill stand.

When the workpiece begins to laterally deviate, there is occuring the difference in roll gap between the work and drive sides 36 and 37. FIG. 9(A) shows a case where the roll gap at the drive side 37 is larger than that at the work side 36. Assume that the thickness of the entering workpiece s is uniform along the width of the workpiece s; then, the workpiece s inclines toward the drive side 37 at the entering side of the rolling-mill stand as explained previously. The sheet edge sensor at the entering side of the rolling-mill stand having the distance $l_E$ from the roll gap can instantly sense a deviation amount $\delta_1$ of the workpiece s due to the inclination $\theta_1$ thereof. Whereas, any sheet edge sensor at the discharge side of the rolling-mill stand having the distance $l_D$ from the roll gap cannot sense any deviation since the workpiece does not laterally deviate yet at the discharge side of the rolling-mill stand.

Two points A and B on the sheet edges of the workpiece at the position of the entering side sheet edge sensor reach to points A′ and B′ at the roll gap with the lapse of time $t_1=l_E/v_1$ (Though, strictly speaking, the inclination of the workpiece s at the entering side continuously varies with the lapse of time, assume that the inclination is constant). That is, the edge points A and B on the workpiece inclined as shown in FIG. 9(A) are parallely displaced to the points A′ and B′ so that there occurs a lateral deviation $\delta_2'$ toward the drive side 37 at the entering side sheet edge sensor as shown in FIG. 9(B). In this way, lateral deviation progresses as the workpiece s passes. At this point of time, no lateral deviation is seen at the discharge-side sheet edge sensor having the distance $l_D$ from the roll gap. By contrast, not only the lateral deviation $\delta_2'$ but also a deviation $\delta_2$ due to a inclination $\theta_2$ of the workpiece at the entering side can be sensed by the entering side sheet edge sensor.

FIG. 9(C) shows the state that the points A′ and B′ reach to points A″ and B″ at the discharge side sheet edge sensor with the lapse of time $t_2=l_D/v_2$. In this point of time, a lateral deviation $\delta(=\delta_2')$ is sensed by the discharge-side sheet edge sensor. However, the deviation is by far smaller than an actual deviations $\delta_3'$ ($\delta_3'$ is a parallel displacement at the roll gap and at the position f the entering-side sheet edge sensor) and is sensed by the discharge side sheet edge sensor with the lapse of time $t_2$ after the lateral deviation $\delta_2'$ occurred at the roll gap. That is, detecting the lateral displacement at the discharge side of the rolling-mill has always time lag.

As is clear from the foregoing, a sheet edge sensor at the entering side of the rolling-mill stand is by far more advantageous than that at the discharge side from the viewpoint of control.

Referring to FIG. 8, the output of the sheet edge sensor 63 is applied to an arithmetic unit 64 for computing the lateral deviation movement of the workpiece s and an output from the arithmetic unit 64 is applied to a comparator 65 to be compared with a set-point signal 66 from a set-point control circuit (not shown). The output signal Δx from the comparator 65 is processed by a lateral deviation moevement control unit 67 and an output of which is applied as a bending pressure correction signal Δp to the bending controllers 29*a* and 29*b*.

In the initial stage of the rolling operation, a relay (not shown) is turned off so that the initial position of the metal workpiece s detected by the sheet edge sensor 63 is stored as a set-point of the position of the workpiece s in a memory. The output from the memory is applied as a set-point signal 66 to the comparator 65.

The output signal from the sheet edge sensor 63 which continuously detects the edges of a workpiece s is applied to the arithmetic unit 65 so that the lateral deviation movement of the workpiece s is calculated and then compared with the set-point signal 66 in the comparator 65. An output signal Δx from the comparator 65 and representative of an lateral deviation is applied to the lateral deviation movement control unit 67 which in turn calculates a pressure correction Δp to be applied to the roll bending control systems 28*a* and 28*b* based on, for instance, the following equation:

$$\Delta p = K_p \Delta x + T_d \frac{d}{dt}(\Delta x) + \frac{1}{T_i}\int(\Delta x)dt$$

where $K_p$: a proportional gain, $T_d$: a differential gain, and $T_i$: an integral gain.

The pressure correction Δp thus obtained is applied to the bending controllers 29*a* and 29*b* in the roll bending control systems 28*a* and 28*b*. For instance lateral deviation movement of the metal workpiece s is directed to the work side 36 as in the case of the first embodiment, in the bending controller 29*a* Δp is substracted from the work side initially set bending pressure $P_w$ while in the bending controller 29*b* Δp is added to the drive-side initially set bending pressure $P_w$. The command signals $i_a$ and $i_b$ representative of $P_w-\Delta p$ and $P_w+\Delta p$ from the bending controllers 29*a* and 29*b* are applied to the servo valves 30*a* and 30*b*, respectively. Then the servo valves 30*a* and 30*b* control the flow rates of working fluid to be discharged from and charged into the hydraulic cylinders 18*a* and 18*b* respectively. As a result, the pressure in the hydraulic cylinder 18*a* drops by Δp while the pressure in the hydraulic cylinder 18*b* is increased by Δp. Since the roll bending pressure on the work side drops while the roll bending pressure on the drive-side is increased, the roll gap on the work side is reduced while the roll gap on the drive-side is increased. Since the lateral deviation movement of the workpiece s can be prevented by narrowing the roll gap on the side toward which the workpiece s is deflected, control of the workpiece s in the manner described above impedes the lateral deviation movement of the workpiece s toward the work side to thereby return the workpiece s to a set point.

The pressure sensors 31*a* and 31*b* continuously detect the roll bending pressures and when the roll bending pressure becomes $P_w-\Delta p$ on the work side while the roll bending pressure becomes $P_w+\Delta p$ on the drive side, no command signals are derived from the bending controllers 29*a* and 29*b* so that the servo valves 30*a* and 30*b* stop the change and discharge of the working fluid. That is, the pressure correction Δp is decreased as the workpiece s approaches the set-point by the control; the servo valves 30*a* and 30*b* control continuously the flow rates of the working fluid charged into or discharged from the hydraulic cylinders as mentioned previously, depending upon such being decreased pressure Δp. Finally, the lateral displacement of workpiece s has reached the initial set-point.

It is assumed that the inlet or entrance tensile stresses of the first, second and third roll gaps are $t_1$, $t_2$ and $t_3$. These tensile stresses $t_1$, $t_2$ and $t_3$ change depending upon the rolling conditions and especially the tensile stress $t_1$ of the first roll gap is decreased so that the lateral deviation movement of the workpiece s tends to occur in the first roll gap 15. Therefore, the first roll gap 15 is controlled in the manner described above to prevent only the lateral deviation movement of the workpiece s passing through the first roll gap 15 so that the rolling operation can be sufficiently stabilized.

Figure 10:
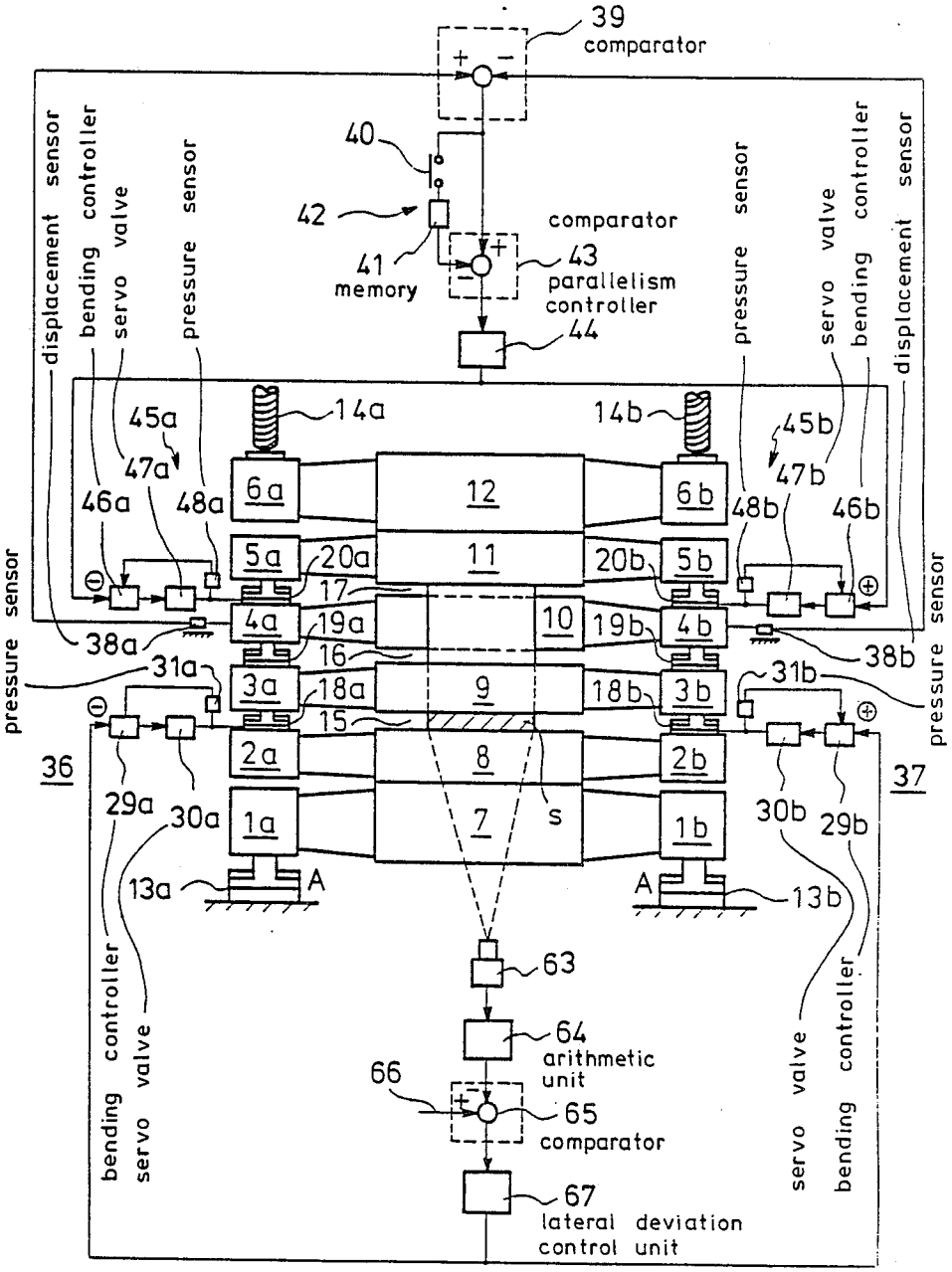
FIG. 10 is a front view of a fifth embodiment of the present invention.

FIG. 10 shows a fifth embodiment of the present invention in which the lateral deviation movement through the first roll gap 15 is controlled or restricted in a manner substantially similar to that described above with reference to the fourth embodiment and the parallelism between the work rolls along the third roll gap 17 is controlled. The arrangement of various equipment devices for controlling the parallelism between the work rolls along the third roll gap 17 is substantially similar to that described above with reference to the second embodiment of the invention.

When the rolling operation is started, the reduction screws 14*a* and 14*b* are driven by the electric motors (not shown) so that they are moved downwardly to exert a load without a workpiece s being passed through a rolling-mill stand. As a result, the rolls are made into contanct with each other and in this case, the amount of the working fluid in the hydraulic cylinders 13*a* and 13*b* in the work-side and drive-side hydraulic reduction control systems A are adjusted so as to eliminate the difference in load in the lateral direction of the rolls.

Upon completion of "leveling", the relay 40 in the set-point control circuit 42 is turned on so that the output from the comparator 39 is stored into the memory 41 and used as a set-point of the parallelism of the third roll gap 17. Thereafer, the workpiece s is made to pass between the work rolls as shown in FIG. 7; the reduction screws 14*a* and 14*b* and the hydraulic reduction cylinders 13*a* and 13*b* are actuated to exert a rolling load to the workpiece s being rolled; and the first, second and third roll gaps 15, 16 and 17 are defined. Next the rolling operation is started.

During the rolling operation, the control or restriction of the lateral deviation movement is carried on for the first roll gap 15 in the manner described above with reference to the fourth embodiment and the vertical displacement of the work roll 10 is continuously detected by the displacement sensors 38*a* and 38*b*. The outputs from these displacement sensors 38*a* and 38*b* are compared in the comparator 39 so that a difference signal representative of the difference between the outputs from the sensors 38*a* and 38*b* is derived and consequently the inclination of the work roll 10; that is, the out-of-parallelism of the third roll gap 17 is obtained. The difference signal representative of the out-of-parallelism of the third roll gap 17 is compared with the set-point derived from the memory 41 in the comparator 43 and the output of the comparator 43 is applied to the parallelism controller 44 so that the pressure corrections to be applied to the bending pressure control systems between the work rolls 10 and 11 are calculated.

Especially when a workpiece having a thin thickness is rolled through a single-stand multi-pass rolling-mill stand, a minute distortion of the parallelism of the third roll gap 17 may cause the distortions of a predetermined shape or flatness of a rolled workpiece to break or crack the same. These problems can be substantially overcome when the parallelism is controlled in the manner described above. Instead of the controlling the parallelism of the third roll gap 17, the restriction of the lateral deviation movement of the workpiece being rolled can be effected at the third roll gap 17 in a manner substantially similar to that described above with reference to the first roll gap 15.

Figure 11:
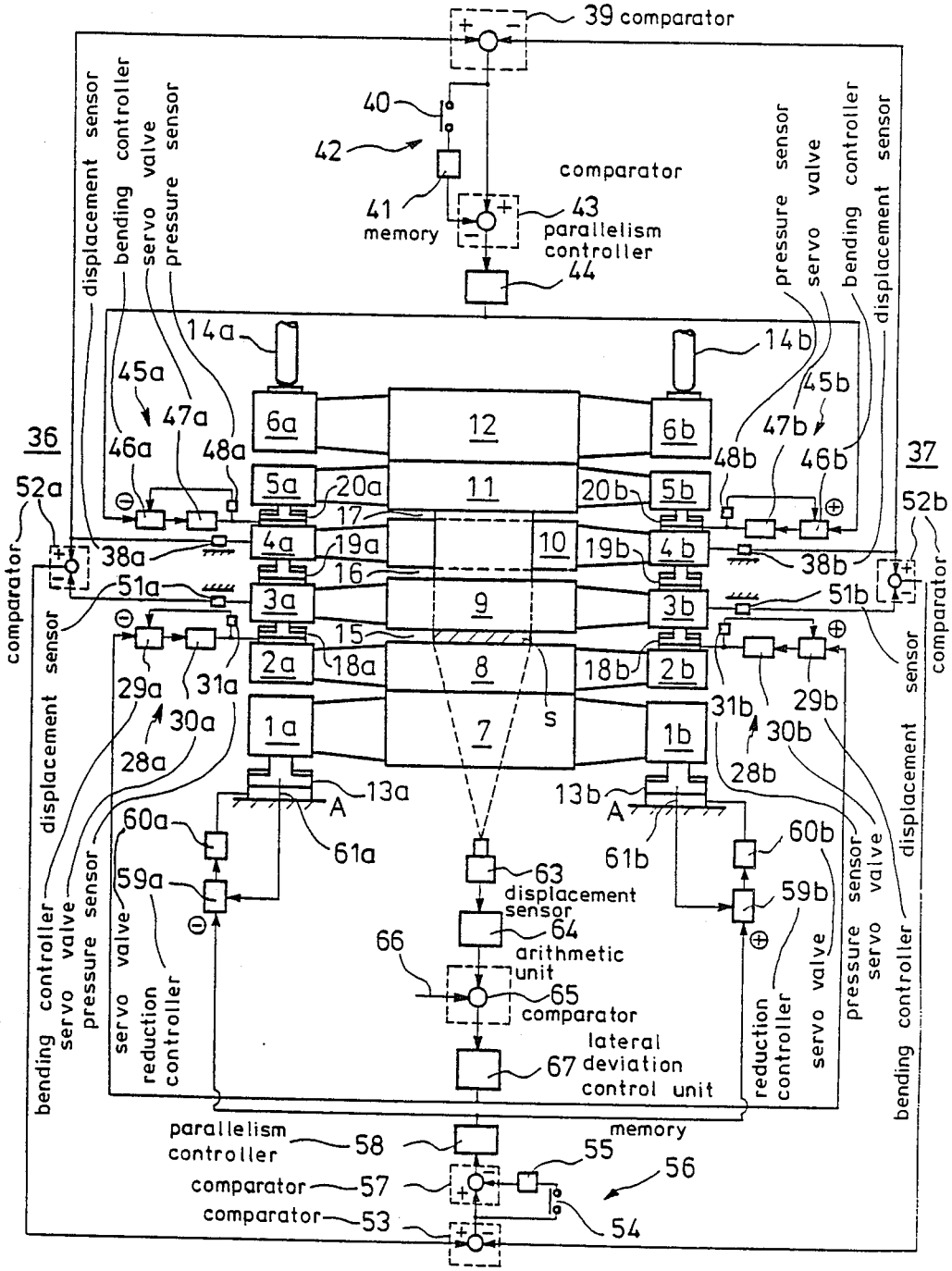
FIG. 11 is a front view of a sixth embodiment of the present invention.

FIG. 11 shows a sixth embodiment of the present invention in which the control or restriction of the lateral deviation movement of the workpiece being rolled through the first roll gap 15 is carried out while the parallelism control of the second and third roll gaps 16 and 17 is effected. The arrangement of equipment and devices for attaining the parallelism at the second and third roll gaps 16 and 17 is fundamentally similar to that of the third embodiment described above with reference to FIG. 6.

When the rolling operation is to be started, a load is applied in a manner substantially similar to that described with reference to the fifth embodiment so that the rolls are made into contact with each other and the "leveling" is carried out by the work-side and drive-side hydraulic reduction control systems A so that no difference in load is produced in the lateral direction of the work rolls. Upon completion of "leveling", a set-point for maintaining the parallelism of the third roll gap 17 is stored into the memory 41 in the manner described elsewhere. Thereafter the workpiece s is made to pass a rolling-mill stand as shown in FIG. 7 and the load is applied to each roll to define the first, second and third roll gaps. Thereafter the rolling operation is started.

The control or restriction of the lateral deviation movement of the workpiece s passing through the first roll gap 15 and the control of the parallelism of the third roll gap 17 are carried out in a manner substantially similar to that described above with reference to the fifth embodiment. The outputs derived from the displacement sensors 51*a* and 51*b* are applied to the comparators 52*a* and 52*b*, respectively, and the outputs derived from the displacement sensors 38*a* and 38*b* are applied not only to the comparator 39 but also to the comparators 52*a* and 52*b*. Since the work rolls 9 and 10 are freely movable vertically, the comparators 52*a* and 52*b* obtain the displacements on the work and drive-sides 36 and 37 of the work rolls 9 and 10. The outputs derived from the comparators 52*a* and 52*b* are compared with each other in the comparator 53 so that the out-of-parallelism of the second roll gap 16 is obtained. The output derived from the comparator 53 is applied to the comparator 57 so as to be compared with the set-point stored in the memory 55 and the output derived from the comparator 57 is applied to the parallelism controler 58 which in turn obtains the position corrections for the hydraulic reduction control systems A which serve to maintain the parallelism of the second roll gap 16. For instance, assume that the work roll 9 is inclined such that the second roll gap 16 is narrower on the work side 36 and is wider on the drive side 37. Then the ram of the hydraulic cylinder 13*a* is lowered by a volume while the ram of the hydraulic cylinder 13*b* is raised by the same volume. As in the case of the control of the parallelism of the third roll gap described elsewhere with reference to FIG. 10, a set point is stored into the memory 55 by applying the output from the comparator 53 to the memory 55 by turning on the relay 54 after "leveling".

In some cases, the control of the second roll gap 16 may adversely affect the parallelism of the first and third roll gaps 15 and 17. However, such distorted first and third roll gaps 15 and 17 can be independently corrected by their respective lateral deviation movement control or restriction systems and parallelism control systems. Therefore, all of the first, second and third roll gaps 15, 16 and 17 can be stably controlled finally. It should be noted that instead of the parallelism control of the second roll gap 16, the lateral deviation movement control or restriction may be effected at the second roll gap 16 in a manner substantially similar to that of the first roll gap 15.

In the embodiments shown in FIGS. 7, 8, 10, 11, the lateral deviation movement control or restriction is effected at the first roll gap 15. Such combination of the lateral deviation movement control or restriction and the parallelism control may be varied if necessary. For example, the parallelism control may be effected at the first roll gap 15 and the lateral deviation movement control, at any other gap.

Figure 12:
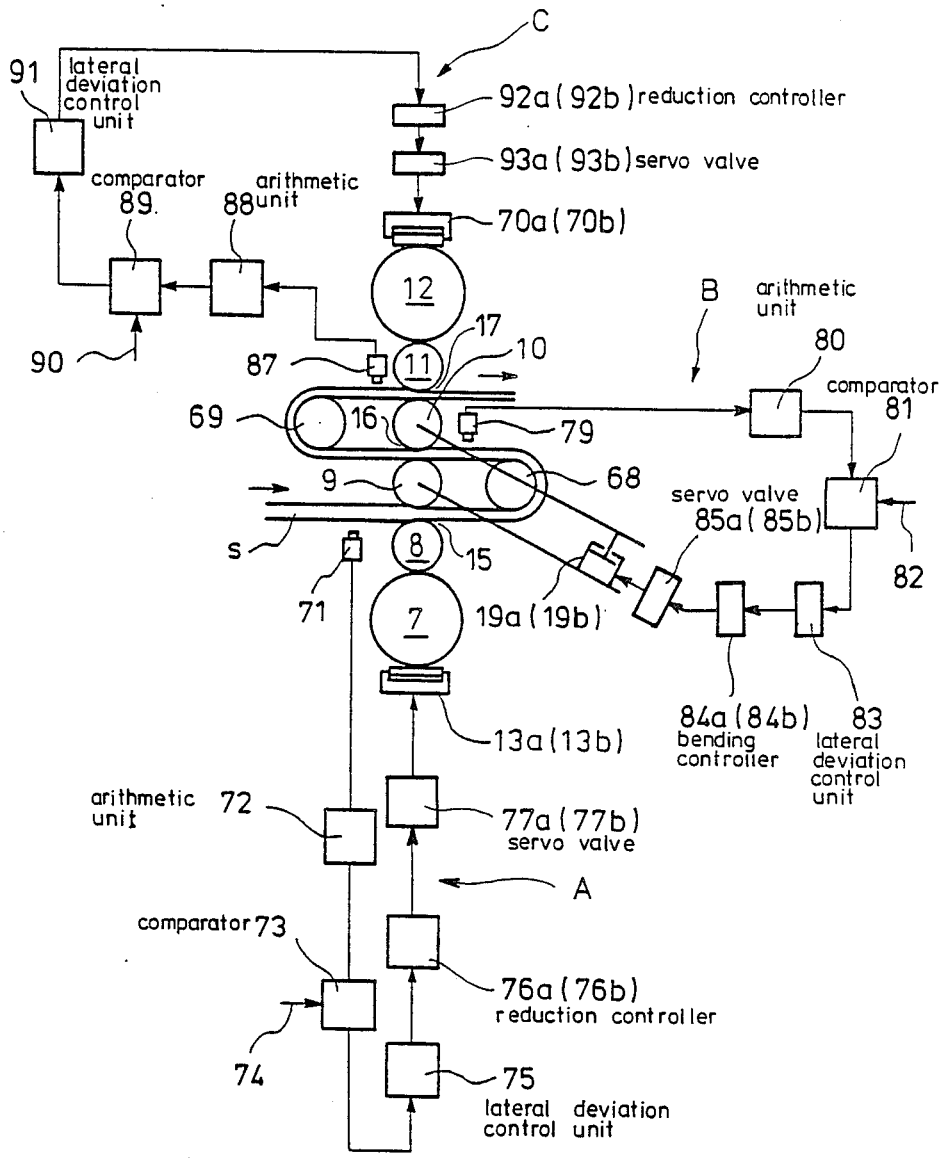
FIG. 12 is a schematic view of a seventh embodiment of the present invention.
Figure 13:
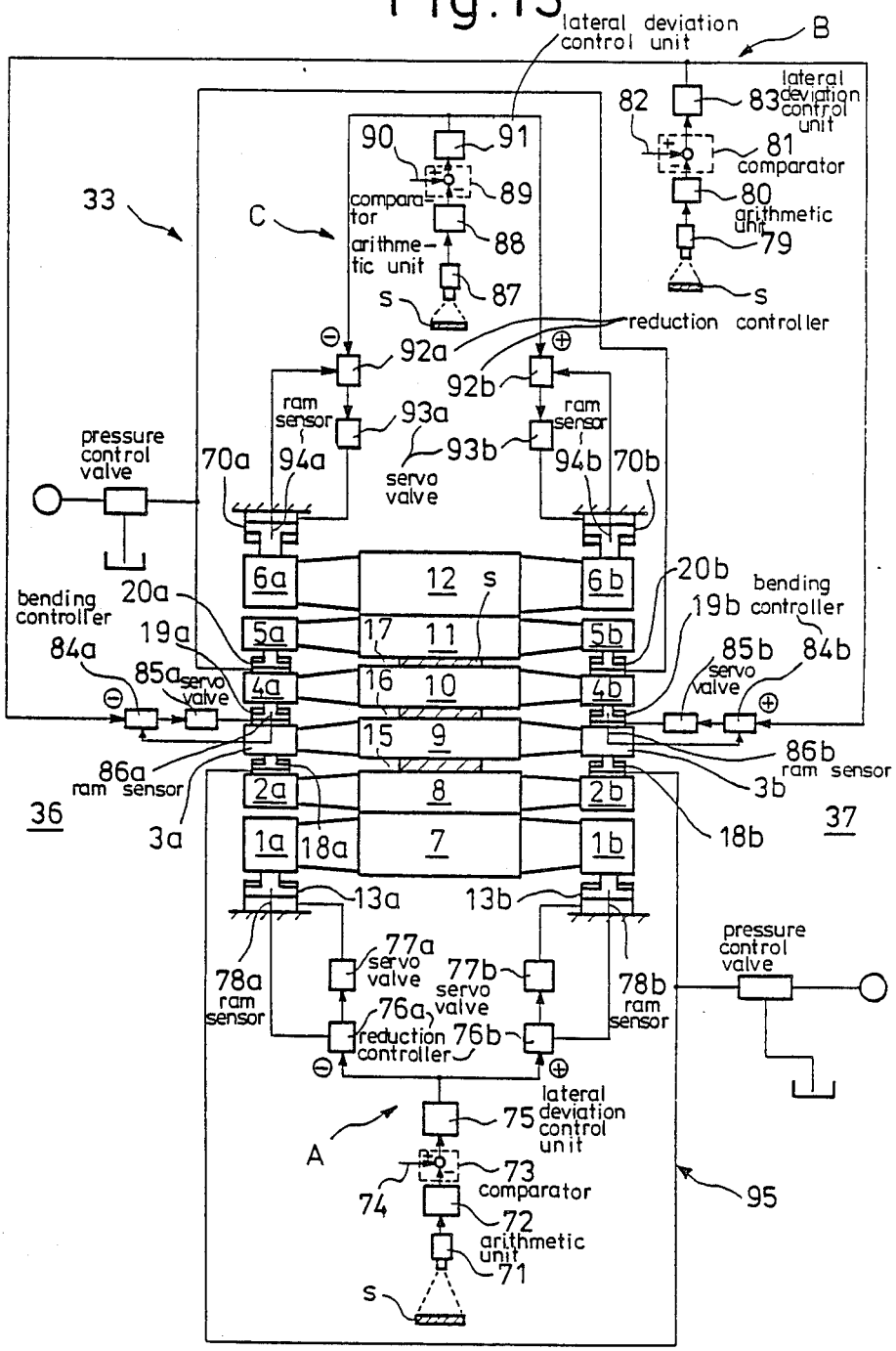
FIG. 13 is a front view thereof.

FIGS. 12 and 13 show a seventh embodiment of the present invention in which a workpiece s is not wrapped around the work rolls 9 and 10 but the workpiece s leaving from the first roll gap 15 defined between the work rolls 8 and 9 is extended forwardly and partially wrapped around a draw roll 68 so as to reverse its direction toward the second roll gap 16 defined between the work rolls 9 and 10. The workpiece s leaving the second roll gap 16 is extended backwardly and partially wrapped around a draw roll 69 so as to reverse its direction toward the third roll gap defined between the work rolls 10 and 11 and in which the lateral deviation movements of the workpiece s are controlled or restricted in all of the three first, second and third roll gaps. In the seventh embodiment, the control or restriction of the lateral deviation movement of the workpiece s passing through the first roll gap 15 is effected by means of the hydraulic reduction cylinders 13*a* and 13*b* through the lower hydraulic reduction control systems A; the control or restriction of the lateral deviation movement of the workpiece s passing through the second roll gap 16 is effected by means of the roll bending cylinders 19*a* and 19*b* through bending control systems B; and the control or restriction of the lateral deviation movement of the workpiece s passing through the third roll gap 17 is effected by means of hydraulic cylinders 70*a* and 70*b* disposed instead of the reduction screws 14*a* and 14*b* through an upper hydraulic reduction control system C. The arrangements of the hydraulic reduction control systems A and C are substantially similar to those described above with reference to the sixth embodiment. In FIGS. 12 and 13, reference numerals 71, 79 and 87 designate sheet edge sensors; 72, 80 and 88, arithmetic units; 73, 81 and 89, comparators; 74, 82 and 90, set-points of the positions of the workpiece s being rolled; 75, 83 and 91, lateral deviation control units; 76*a*, 76*b*, 92*a* and 92*b*, reduction controllers; 84*a* and 84*b*, bending controllers; 77*a*, 77*b*, 85*a*, 85*b*, 93*a* and 93*b*, servo valves; 78*a*, 78*b*, 86*a*, 86*b*, 94*a* and 94*b*, ram sensors for detecting the displacements of the rams of the hydraulic pistons; and 95 and 33, a first-roll gap and a third-roll gap balance control systems respectively.

With the above-described construction, the lateral deviation movement of the workpiece s through the second roll gap 16 can be independently controlled or restricted by the bending control system B while the lateral deviation movements of the workpiece s through the first and third roll gaps 15 and 17 are independently controlled or restricted by the hydraulic reduction control systems A and B. The lateral deviation movement control or restriction is substantially similar to that of the fourth embodiment described above with reference to FIG. 9 and to that of the sixth embodiment described above with reference to FIG. 11, but it should be noted that the bending control system B for the second roll gap 16 controls the position, not the pressure.

According to the seventh embodiment, the position of the second roll gap 16 is independently controlled so that the mutual interference caused by the control of each roll gap is weak. Furthermore, the first and third roll gaps 15 and 17 are also controlled independently of each other so that the effective control can be attained to a great extent. Moreover, according to the seventh embodiment of the present invention, while the arrangement of actuators remains unchanged, the parallelism of any roll gaps may be controlled in response to the difference in roll gap between the right and left sides as described above with reference to the fifth and sixth embodiments.

Figure 14:
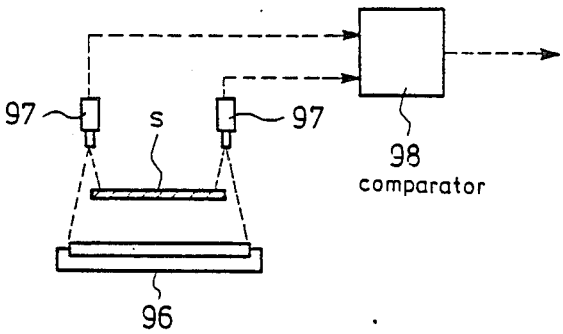
FIGS. 14 and 15 are views used to explain the sheet edge sensors used in the present invention.

FIG. 14 shows an example of the sheet edge sensors used in the above-described lateral deviation movement controllers. A light source 96 is disposed below the workpiece s and sheet edge sensors 97 receive the light emitted from the light source 96. When the sheet edge sensors 97 are disposed on both side edges of the workpiece s, a comparator 98 compares the output signals from the right and left sheet edge sensors 97 so that a degree of lateral deviation movement can be obtained in terms of a difference signal from the comparator 98.

Figure 15:
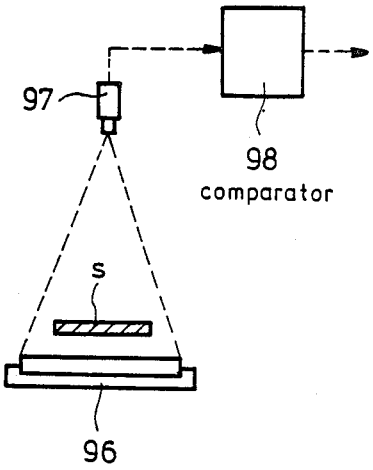

Especially in the case of rolling a workpiece s with narrower width, a single sheet edge sensor may be used for determining a degree of lateral deviation movement as shown in FIG. 15.

Figure 16:
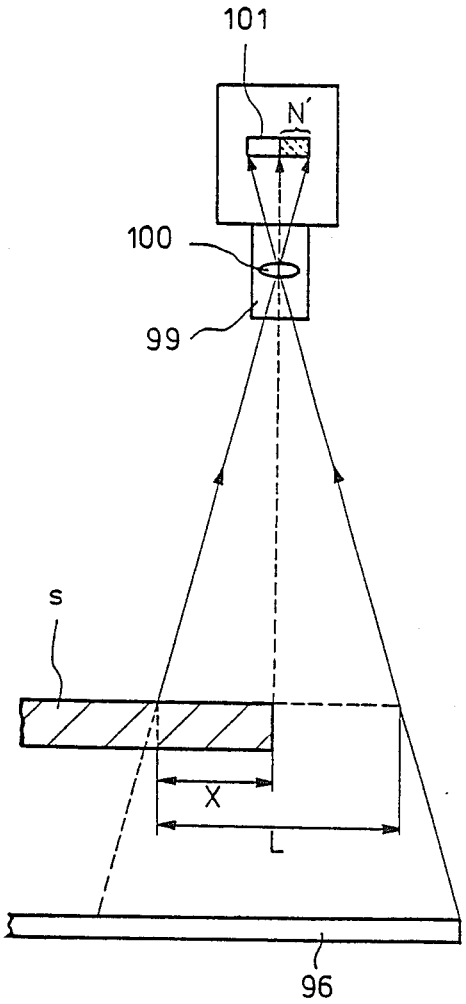
FIG. 16 is a detailed view of the edge sensor.
Figure 17A:
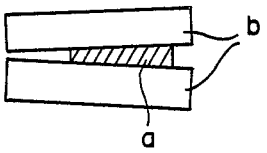
PRIOR ART Fig. 17A
FIGS. 17(A) to 17(D) help explain the lateral deviation movement of a workpiece being rolled.
Figure 17B:
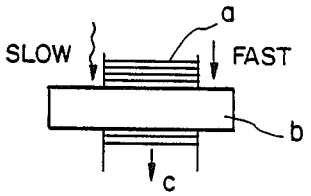
PRIOR ART Fig. 17B
Figure 17C:
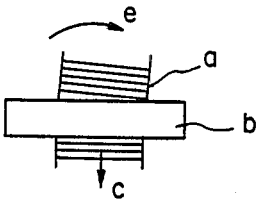
PRIOR ART Fig. 17C
Figure 17D:
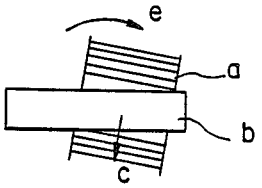
PRIOR ART Fig. 17D

FIG. 16 shows in detail the above-described sheet edge sensor. The light rays emitted from the light source 96 are focused through a lens 100 disposed in a lens barrel 99 upon an array of photodetector elements 101 spaced apart from each other by a uniform distance so that the position of the side edge of the workpiece s can be detected.

If the number of photodetector elements is N; the length of a field of view is L; and the number of photodetector elements which do not receive any light rays because a portion X in length of the side edge of the workpiece s is extended into the path of the light rays emitted from the light source 96 is N', then $$X = N' \times L/N$$

The value X varies in response to the movement of the workpiece s in its widthwise direction so that the position of the side edge of the workpiece s can be detected in terms of X.

Same reference numerals are used to designate similar parts throughout the figures.

It is to be understood that the present invention is not limited to the above-described preferred embodiments thereof and that various modifications may be effected without departing the true spirit of the present invention. For instance, the control circuits may be made up of software utilizing a computer, not of hardware. The light source and the photodetectors are disposed on the entering or discharge side of the rolling-mill stand. The light source may be disposed above a workpiece while the photodetectors may be disposed below the workpiece. The lateral deviation movement controllers may be conventional amplifiers, circuits utilizing the proportional gain, proportional-plus-differential controllers, proportional-plus-differential-plus-integral controllers depending upon external disturbances encountered in the case of metal rolling.

According to the present invention, the lateral deviation movement of a workpiece can be prevented or restricted so that the stabilized rolling operation can be ensured. As a result, accidents caused by the lateral deviation movement of a workpiece can be avoided and the rate of operation can be improved. Furthermore, a high power required for exerting the high tension force to a workpiece in order to prevent the lateral deviation movement thereof is not needed so that the energy saving can be attained. In addition, the difference in roll gap between the right and left sides can be eliminated so that the shape or flatness of the finished products can be maintained extremely close tolerances.

What is claimed is:

1. In a rolling-mill stand of the type in which three or more work rolls are arranged one above the other and a metal workpiece is simultaneously rolled at two or more points by at least one work roll, a multi-pass rolling-mill stand comprising first, second and third roll gaps, a sheet edge sensor disposed adjacent to a path of the metal workpiece which is passing through said second roll gap, said sheet edge sensor being located at the entrance of said second roll gap, lateral deviation movement sensors for obtaining a degree of lateral deviation movement of the workpiece at the entrance of said second roll gap from output signals from said sheet edge sensor, and bending control or reduction control means responsive to a degree of the lateral deviation movement thus detected for changing the roll gap on the work and drive-sides of said second roll gap concurrently and independently of each other, further sheet edge sensors located at the entrance of said first and third roll gaps and located adjacent to a path of the metal workpiece passing through said first and third roll gaps and further lateral deviation movement sensors for obtaining a degree of lateral deviation movement of the workpiece at the entrances of said second and third roll gaps, respectively, means connected to said further lateral deviation movement sensors and responsive to signals generated by said further sheet edge sensors and controlling said first and third roll gaps independently of each other and independently of said first roll gap for preventing lateral deviation movement of the workpiece.

2. A stand according to claim 1 further comprising bending control means for changing the roll gaps on the work and drive-sides of each roll in response to a roll gap difference.

3. A stand according to claim 1 further comprising reduction control means for changing the roll gaps on the work and drive-sides of each roll in response to a roll gap difference.

* * * * *

UNITED STATES PATENT AND TRADEMARK OFFICE

CERTIFICATE OF CORRECTION

PATENT NO. : 4,759,205

DATED : July 26, 1988

INVENTOR(S) : Hiroaki Kuwano

It is certified that error appears in the above-identified patent and that said Letters Patent is hereby corrected as shown below:

In column 14, line 53, in line 23 of claim 1, "second" should read -- first --.

Signed and Sealed this

Twenty-fifth Day of July, 1989

*Attest:*

*Attesting Officer*

DONALD J. QUIGG

*Commissioner of Patents and Trademarks*